US005325045A

United States Patent [19]

Sundby

[11] Patent Number: 5,325,045

[45] Date of Patent: Jun. 28, 1994

[54] LOW VOLTAGE CMOS BANDGAP WITH NEW TRIMMING AND CURVATURE CORRECTION METHODS

[75] Inventor: James T. Sundby, Tracy, Calif.

[73] Assignee: Exar Corporation, San Jose, Calif.

[21] Appl. No.: 18,638

[22] Filed: Feb. 17, 1993

[51] Int. Cl.[5] ..... G05F 3/30

[52] U.S. Cl. ..... 323/313; 323/314; 323/316

[58] Field of Search ..... 323/313, 314, 315, 316; 307/296.1, 296.2, 296.8

[56] References Cited

U.S. PATENT DOCUMENTS

| | | | |
|---|---|---|---|
| 4,138,671 | 2/1979 | Comer et al. | 340/347 |
| 4,250,445 | 2/1981 | Brokaw | 323/313 |
| 4,573,005 | 2/1986 | van de Plassche | 323/315 |
| 4,604,568 | 8/1986 | Prieto | 323/315 |
| 4,808,908 | 2/1989 | Lewis et al. | 323/313 |
| 4,902,959 | 2/1990 | Brokaw | 323/314 |
| 5,051,686 | 9/1991 | Schaffer | 323/313 |
| 5,055,902 | 10/1991 | Lambert | 357/41 |
| 5,200,654 | 4/1993 | Archer | 307/491 |

OTHER PUBLICATIONS

"A Programmable CMOS Dual Channel Interface Processor for Telecommunications Applications," IEEE J. Solid-State Circuits, vol. SC-19, No. 6, pp. 892-899.

"Integrated Circuits and Components for Bandgap References and Temperature Transducers" by Gerald C. M. Meijer, Dept. of Electrical Engineering, Delft University of Technology.

*Primary Examiner*—Emanuel T. Voeltz
*Assistant Examiner*—Y. Jessica Han
*Attorney, Agent, or Firm*—Townsend and Townsend Khourie and Crew

[57] ABSTRACT

A bandgap circuit for generating an accurate and stable reference voltage at low power supply voltages. Stacking of bipolar devices allows for a lower opamp closed-loop gain, which in turn reduces the error voltage contribution to the output due to opamp offset. A CMOS opamp having NMOS input reference transistors coupled with a new bandgap architecture allows a 1.2 v reference (unlike other stacked architectures) without sacrificing low voltage operation. A new trimming method provides for very efficient trimming of bandgap output voltage. Instead of fine tuning the output voltage by trimming ratioed resistors, the output voltage is trimmed by either changing the area of ratioed bipolar transistors, or changing the magnitude of ratioed currents in equally sized bipolar transistors. Therefore, very fine trimming resolution is possible because of the logarithmic function defining the current or transistor size ratios. A new curvature correction method reduces curvature without requiring additional circuitry. Curvature can be drastically reduced by using resistors with negative temperature coefficient.

21 Claims, 5 Drawing Sheets

LOW VOLTAGE CMOS BANDGAP WITH NEW TRIMMING AND CURVATURE CORRECTION METHODS

BACKGROUND OF THE INVENTION

The present invention relates generally to bandgap reference circuits, and in particular to low voltage bandgap circuits with trimming and curvature correction methods.

The output voltage of a bandgap reference circuit is as follows:

$$V_{ref} = V_{be} + (K \times \Delta V_{be})$$

where:

K is a gain factor set by a resistor ratio, and

Vbe is a bipolar transistor base-emitter voltage drop.

The output of a bandgap circuit is typically around 1.2 v. Improved bandgap circuits include an operational amplifier (opamp) to improve power supply rejection. The opamp is connected in a feedback loop with a closed-loop gain of K. This gain amplifies any inherent opamp offset voltage, which then appears as an error voltage at the output of the bandgap circuit. To reduce the error voltage contribution due to the opamp output-referred offset, different techniques are used to lower the amount of the required closed-loop gain. For a fixed output voltage ($V_{ref}$), the closed-loop gain (K) may be reduced if the value of the $\Delta V_{be}$ term is made larger. Two different methods are used to generate the $\Delta V_{be}$ term: (1) differing amounts of currents are forced through two identical diode connected bipolar transistors or (2) an equal amount of current is forced through two bipolar transistors having different sizes. Both of these methods require adding a large number of transistors to obtain either (1) an appreciable current differential, or (2) an appreciable transistor size differential.

A more efficient way of increasing the value of the $\Delta V_{be}$ term is to connect another diode connected bipolar transistor in series with each one of the diode connected bipolar transistors that generate the $\Delta V_{be}$ term. This way the $\Delta V_{be}$ term can be, for example, doubled when two diodes are stacked, or tripled when three diodes are stacked. Stacking the bipolar transistors however, creates two potential problems. First, the resulting output voltage of the reference circuit is no longer 1.2 v, but a higher multiple of that voltage (i.e. 2.4 v, or 3.6 v) (see IEEE JSSC, pg. 896, FIG. 6). Secondly, such stacking limits the voltage range in which the bandgap circuit can properly operate. This is so for several reasons. First, the power supply cannot be lower than the output voltage. If the output voltage is not 1.2 v but rather a multiple of 1.2 v, this can be a problem. Secondly, the portion of the circuitry that generates the $\Delta V_{be}$ (or rather, some multiple of $\Delta V_{be}$) needs more headroom to operate when stacked. Therefore, low voltage operation of the bandgap circuit is sacrificed to reduce the error voltage due to opamp offset.

In bandgap circuits, it is often necessary to fine tune the circuit to obtain highly accurate reference voltages. This fine tuning is accomplished by trimming the resistor ratio to change the K factor in very small steps. To obtain fine resolution with resistor trimming, however, is costly in several respects. First, provisions for a resistor bank and the corresponding switching circuitry consumes valuable silicon area. Secondly, the switching mechanism in resistor trimming adds more complexity and places additional requirements on the circuit. If, for example, transistor switches are used to switch trimming resistors in and out, transistor resistances would have to be accounted for, which may result in very large switch transistors and/or very large resistors. In addition, decoding may be required for the switches, which would use up more area. Other trimming techniques require a silicon fabrication process that supports zener zapping (to short or insert resistors) and fusible metal. links (to remove resistors). Not all CMOS processes can support zeners. Existing resistor trimming techniques are therefore, costly and inflexible.

Another critical feature of a bandgap circuit is its temperature performance. Bandgap circuits are designed to yield an output voltage with zero temperature coefficient (TC), at a particular temperature TO (e.g. 25° C.). However, the bandgap output voltage drops as temperature departs from TO in either direction. Existing curvature correction schemes involve either a specially designed architecture, or require adding positive TC resistors in series with the emitter or a base of some of the $\Delta V_{be}$ bipolar transistors. This also adds to circuit complexity and cost.

SUMMARY OF THE INVENTION

The present invention provides a bandgap circuit with stacked diodes to reduce output-referred opamp offset voltage while still providing an output of 1.2 v, without sacrificing the low voltage operation.

Low voltage bandgaps designed in N-well CMOS process typically use PMOS devices for the opamp input (there isn't enough voltage margin between the inputs and ground for NMOS transistors). In the present invention, the special architecture that allows 1.2 v at the output would also increase the minimum allowable supply voltage by 0.7 v if the opamp were to continue using PMOS for its input. However, because the special architecture has also raised the opamp input by 0.7 v, NMOS transistors for the input can now be used. This permits a minimum allowable supply that is very comparable to the standard stacked architectures that do not provide a 1.2 v reference.

Further, the bandgap circuit of the present invention provides a novel trimming technique, whereby a higher trimming resolution requirement results in lower use silicon area. The $K \times \Delta V_{be}$ term is equal to the thermal voltage $V_t$ (or kT/q) times Kxln(N), where N is either a ratio of bipolar transistor areas or a ratio of the magnitude of the currents forced through the bipolar transistors. To trim the weighting of the $\Delta V_{be}$ term, instead of changing the sizes of the resistors (the K term), the bandgap circuit of the present invention changes N. In one embodiment, the bandgap circuit of the present invention changes the N term by inserting a small trimming bipolar transistor in parallel with either one of the larger bipolar transistors. Similarly, in another embodiment, the bandgap circuit of the present invention changes the N term by inserting a small current source transistor in parallel with one of the larger current sources. In both embodiments the logarithmic function provides for very fine resolution. Furthermore, binary weighted trimming bipolar transistor sizes, or trimming current source device sizes, eliminates the need for a decoder to perform the trimming function.

In another embodiment, the bandgap reference circuit of the present invention provides a curvature correction design that does not require any additional circuitry. The bandgap reference circuit of the present invention utilizes ratioing resistors that have negative temperature coefficient. (TC) instead of the usual positive TC resistors. The negative TC resistors vastly improve the curvature of the bandgap circuit.

A further understanding of the present invention may be had with reference to the description and diagrams below.

BRIEF DESCRIPTION OF THE DRAWINGS

FIG. 4A shows an ideal bandgap circuit connected to a bipolar trimming circuit block according to one embodiment of the present invention, while

DESCRIPTION OF THE PREFERRED EMBODIMENT

Figure 1:
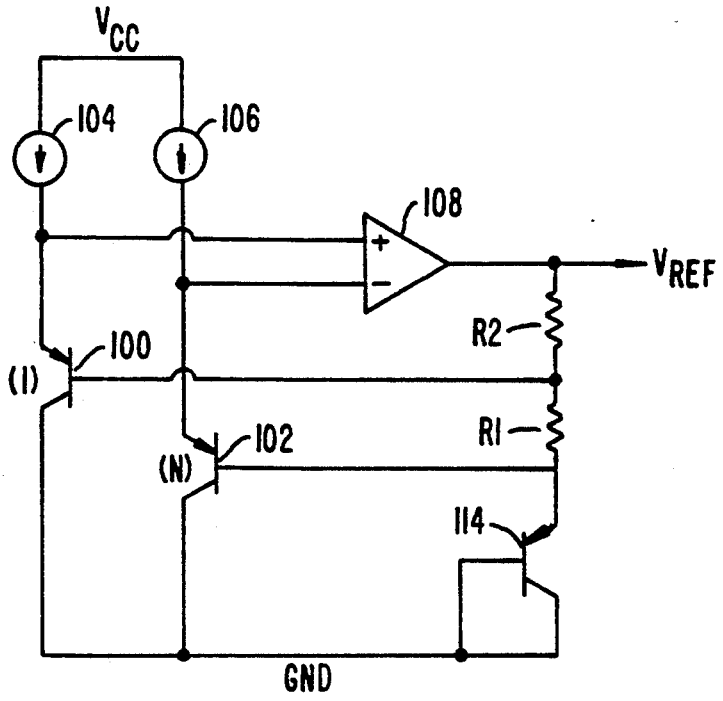
FIG. 1 is a simplified circuit diagram of the band a reference circuit of the present invention.

A bandgap reference circuit operates on the principle of compensating the negative temperature drift of the turn on voltage of a diode ($V_{be}$) with the positive temperature coefficient (TC) of the thermal voltage ($V_t$) to obtain a reference voltage with zero TC. FIG. 1 is a simplified circuit diagram of a bandgap reference circuit (in a N-well CMOS process) of the present invention. The collector terminals of two PNP transistors 100 and 102 connect to ground, while their emitter terminals connect to positive and negative inputs of opamp 108, respectively. Current sources 104 and 106 bias the PNP transistors 100 and 102 with equal currents. The output of opamp 108 is the reference voltage $V_{ref}$, and feeds back to the base terminal of PNP 100 through resistor R2. The base of PNP 100 connects to the base of PNP 102 through resistor R1. The base of PNP 102 also connects to the emitter terminal of a diode-connected PNP transistor 114. The base and the collector of PNP 114 connect to ground. Such PNP devices, with their collectors tied to the negative supply, are available in a n-well cmos process.

The voltage at $V_{ref}$ is equal to the voltage drop across R1 and R2, plus the $V_{be}$ of PNP 114. Opamp 108 works to maintain the voltage at its two inputs at the same potential. Given current sources 104 and 106 of equal value, equal amounts of current must flow through PNP 100 and PNP 102. Therefore, a size differential between the areas of the two PNP transistors 100 and 102 would generate a voltage differential between their $V_{be}$'s. The voltage developing across R1 must therefore be equal to the difference between the $V_{be}$'s ($\Delta V_{be}$) of the two PNP transistors 100 and 102. Assuming that the base currents in PNP 100 and PNP 102 are negligible, the current in resistors R2 and R1 is equal to $\Delta V_{be}$ divided by the value of R1. Accordingly, $V_{ref} = V_{be} + (1 + R2/R1) \times (\Delta V_{be})$ . If PNP 102 is N times larger than PNP 100, the voltage differential $\Delta V_{be}$ would equal the thermal voltage $V_t$ times ln(N). The complete equation for $V_{ref}$ is therefore as follows:

$$V_{ref} = V_{be} + [(1 + R2/R1) \times ln(N)] V_t$$

Because $V_{be}$ and $V_t$ have opposite TC's, proper weighting of the R2/R1 ratio or the term N, could result in a reference voltage $V_{ref}$ that is temperature insensitive.

A problem with this circuit is the error caused by the output-referred offset voltage of opamp 108. Any opamp offset voltage adds directly to the $\Delta V_{be}$ term, and is therefore amplified by (1+R2/R1). This voltage appears as an error voltage at the output of the bandgap circuit. One way to reduce this error voltage is by increasing the $\Delta V_{be}$ term. For a fixed $V_{ref}$, increasing $\Delta V_{be}$ allows for a lower R2/R1 ratio, reducing the amount of gain by which the offset voltage is amplified. To increase the $\Delta V_{be}$ term, additional bipolar transistors can be stacked on top of PNP transistors 100 and 102. This way, if two transistors are stacked, the $\Delta V_{be}$ term doubles.

Figure 2:
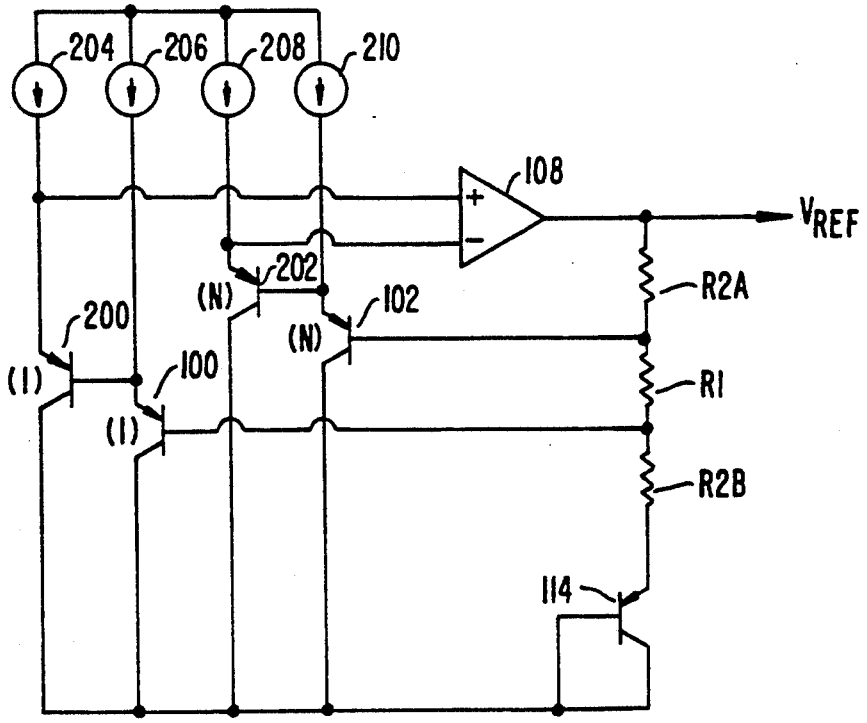
FIG. 2 is a circuit diagram of a preferred embodiment of the present invention showing the bandgap architecture with diode stacking.

FIG. 2 is a simplified circuit diagram of a preferred embodiment of the present invention. This circuit reduces the error voltage contribution due to opamp 108 offset by stacking two PNP transistors 200 and 202 on top of PNP 100 and PNP 102, respectively. Additional current source loads 204 and 208 similarly couple the emitters of PNP 200 and PNP 202 to the power supply. To reduce the effect of the base currents of PNP 100 and PNP 102, resistor R2 has been divided into two resistors R2A and R2B of equal value. Resistor R2A connects $V_{ref}$ to one side of resistor R1, and resistor R2B connects the other side of resistor R1 to the emitter of diode-connected PNP 114.

Similar to the bandgap circuit in FIG. 1, the feedback around opamp 108 forces a voltage differential to appear across resistor R1. However, this time, because there are two $V_{be}$ drops (PNP's 202 and 102, and PNP's 200 and 100), the voltage differential is equal to $2\Delta V_{be}$. This allows for adjusting the (1+R2/R1) term for a lower gain, which in turn reduces the error voltage contribution due to the output-referred offset of opamp 108.

Figure 3A:
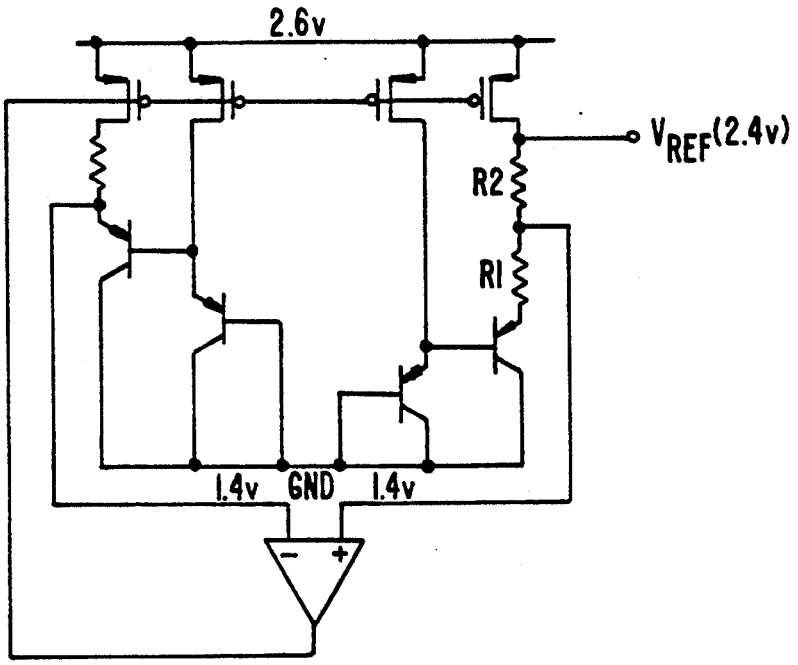
FIG. 3A. (PRIOR ART)
FIGS. 3A and 3B show a prior art stacked bandgap reference circuit and a PMOS differential pair for reference circuit opamp input stage, respectively.
Figure 3B:
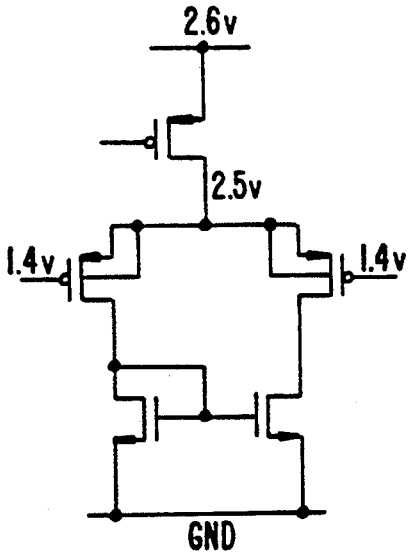

The minimum power supply voltage at which this circuit can operate is set by the requirements of opamp 108. In the prior art bandgap circuit of FIG. 3A, the voltage at the input of opamp is equal to two $V_{be}$'s above ground, or approximately 1.4 v. At this voltage, PMOS transistors would normally be used for the opamp input differential pair, because 1.4 v is too close to ground to safely use NMOS (FIG. 3B). The absolute value of PMOS threshold voltage can be as high as 1.1 v. Given a 1.4 v input voltage, this translates to a minimum power supply limit of approximately 2.6 v (1.4 v+1.1 v+an extra 0.1 v, FIG. 3B).

Figure 3C:
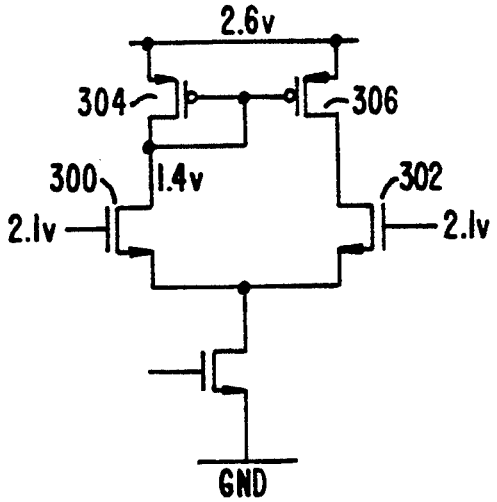
FIG. 3C shows a NMOS differential pair used in the opamp for the bandgap circuit of the present invention.

The new architecture of the present invention generates a 1.2 v output reference voltage. This translates to 2.1 v at opamp 108 inputs (FIG. 3C). If PMOS transistors were used for the opamp input (as in FIG. 3B), the minimum allowable supply voltage would be 3.3 v (2.1 v+1.1 v+0.1 v). However, since the opamp inputs are higher at 2.1 v, NMOS transistors can be used for the differential pair. Referring to FIG. 3C, the new lower power supply limit can be calculated as follows: The drain voltage on NMOS differential pair 300 and 302 can drop as low as one threshold below their gates. Any lower and NMOS transistors 300 and 302 would leave their high gain region and enter triode. Using a worst-case low NMOS threshold voltage of 0.7 v, the drains can drop as low as 1.4 v (2.1 v−0.7 v). Using a worst-case high threshold of 1.1 v for PMOS load devices 304 and 306, the minimum allowable power supply voltage is 2.6 v (1.4 v+1.1 v+an extra 0.1 v). The new architecture, therefore, operates at the same lower power supply limit and enjoys the same stacking advantages as the prior art architecture, while providing an output voltage of 1.2 v.

The current gain $\beta$ of bipolar transistors varies with temperature. This means that the amount of base current (negligible in a high $\beta$ bipolar transistor) also varies with temperature. The base current of PNP 100 in FIG. 1, although small in magnitude, adds to the amount of current that flows in resistor R1. This current introduces a temperature dependent error voltage at output $Vre_f$. The circuit architecture in FIG. 2 eliminates this base current effect. As described above, opamp 108 forces $\Delta V_{be}$ to appear across R1. The current through R1 (IR1) is $\Delta V_{be}$/R1. The current through R2A is, therefore, (IR1+base current), while the current through R2B is (IR1−base current). Since R2B is equal to R2A, the two voltage errors [R2B×(base current)] and [R2A×(base current)] cancel, leaving $V_{ref}$ unaffected. It is also possible to eliminate the effect of the base current in other ways. Rather than split R2 into 2 equal halves as in FIG. 2, a resistor equal to R1 || R2 can be put in series with the base of PNP 100 or 102, depending on whether R1 is above or below R2.

TRIMMING CIRCUIT

The output of the bandgap circuit can be trimmed to obtain a very accurate reference voltage. Referring to the equation for the output of the bandgap circuit, changing the value of $\Delta V_{be}$ modifies $Vre_f$. Existing methods for trimming the weighting of the $\Delta V_{be}$ term involve trimming the resistor ratio R2/R1. To obtain fine resolution with this method is costly in terms of silicon area. Another embodiment of the bandgap circuit of the present invention provides a circuit that trims N in the ln(N) term instead of the resistor ratio. This circuit provides for fine resolution more efficiently because of the logarithmic function.

Figure 4A:
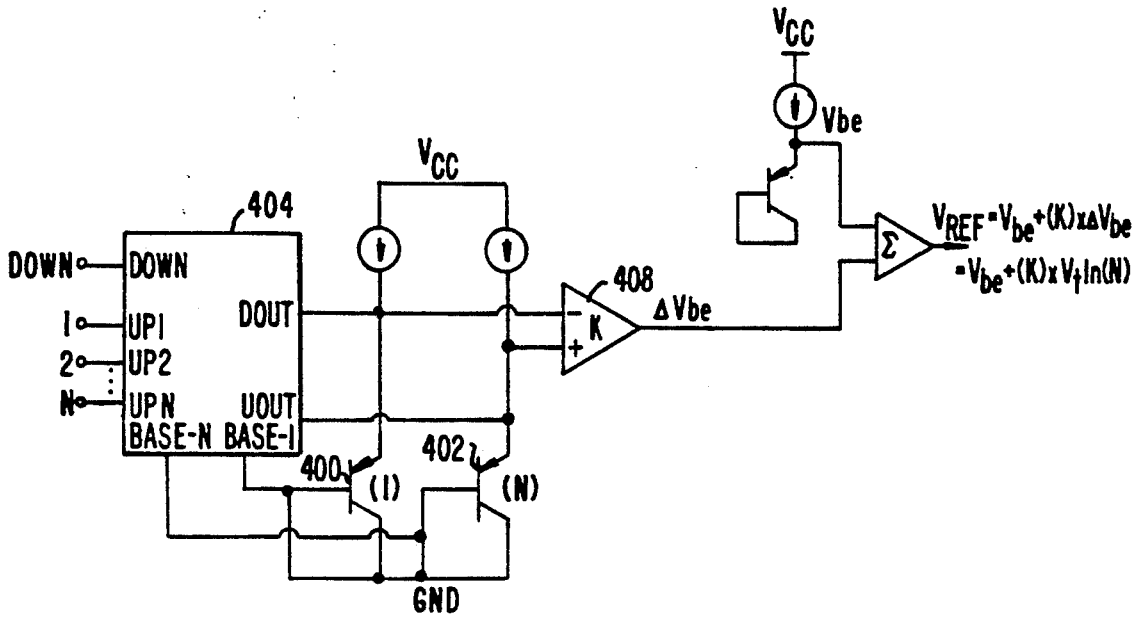
Figure 4B:
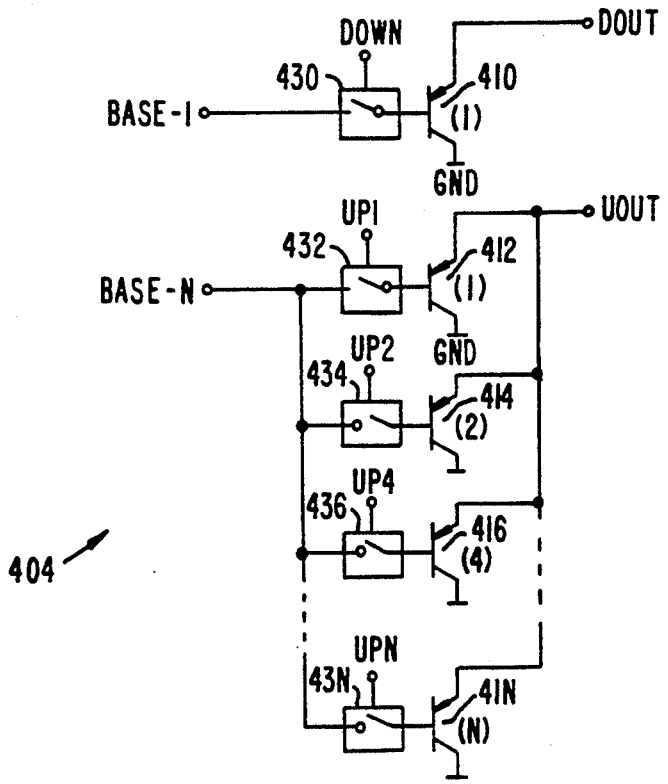
FIG. 4B shows the corresponding bipolar trimming circuit.
Figure 5A:
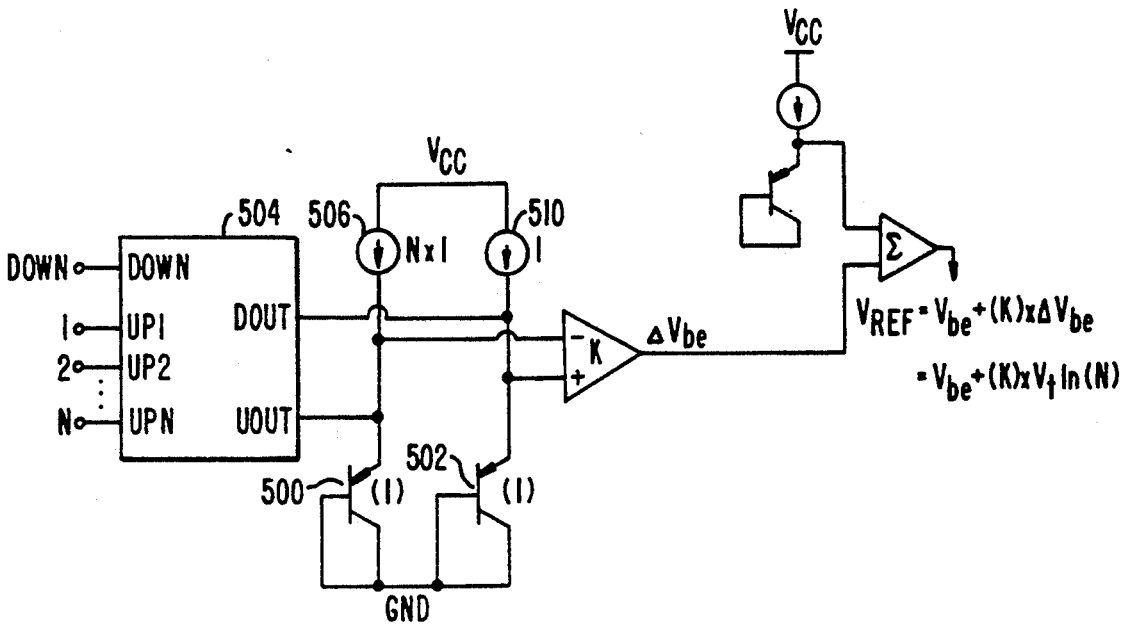
FIGS. 5A and 5B show the ideal bandgap circuit with a current trimming version of the trimming circuit according to another embodiment of the present invention.
Figure 5B:
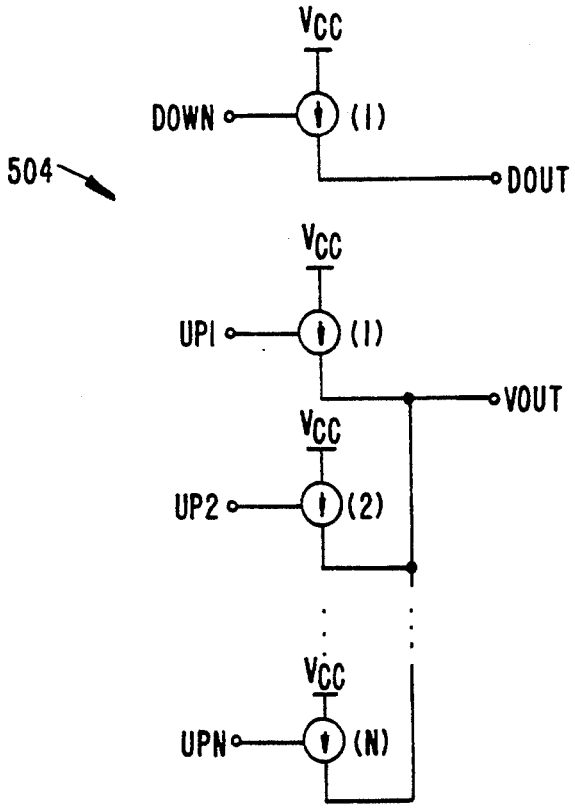

The trimming method of the present invention can be applied to the bandgap circuit of FIG. 2, as well as any other bandgap circuit architecture where N is obtained by either ratioing the bipolar transistor areas, or ratioing the magnitude of currents flowing through equal size bipolar transistors. FIG. 4A is a circuit diagram of an ideal bandgap circuit showing the connection to the bipolar trimming circuit of the present invention, and FIG. 4B is the bipolar trimming circuit. FIG. 5A and 5B show the ideal bandgap circuit with a current trimming version of the trimming circuit of the present invention.

In the bandgap circuit of FIG. 4A, the ratio of the area of diode connected PNP transistor 402 to the area of PNP 400 is N to 1. The bipolar trimming circuit 404 can reduce this ratio by enlarging the area of PNP 400, or increase the ratio by enlarging the area of PNP 402. Bipolar trimming circuit 404 accomplishes this by switching another bipolar transistor in parallel with the desired one of the diode connected transistors. Accordingly, as shown in FIG. 4B, bipolar trimming circuit 404 includes an array of trimming PNP transistors 410 to 41N, connected in parallel to PNP 400 and PNP 402, and operable by a series of switches 430 to 43N. The bipolar trimming circuit of FIG. 4B includes a single trim down PNP 410, which falls in parallel to PNP 400 when switch 430 is closed. This way the ratio N is reduced by one large step. Binary weighted PNP transistors 412 to 41N all connect in parallel to PNP 402, and when switched on, each one adds to the area of PNP 402 reducing the ratio N. As the size of trimming PNP transistors 412 to 41N become smaller, the resolution of steps incrementing N become finer. In addition, 25 when using stacked diodes and the trim circuit 404 is placed around only one $\Delta V_{be}$ device on each side, (rather than all), the trim resolution becomes even finer. It should also be noted that the switches 430, 432, etc., can be minimum size since the only current through them is base current from PNP's 400 and 402.

FIGS. 5A and 5B show a current trimming version of the trimming circuit of the present invention in a bandgap circuit where the magnitude of currents flowing in two equal size diode connected bipolar devices PNP 500 and PNP 502 set the ratio N. The current trimming circuit 504 includes an array of trimming current source devices connected in parallel to current source 506 and current source 510. In a similar fashion to the bipolar trimming circuit, N is modified by activating a particular trimming current source device to add to the current flowing in one or the other of PNP's 500 and 502.

CURVATURE CORRECTION

The output voltage of a bandgap circuit as a function of temperature, when the circuit is tuned to be temperature insensitive at temperature T0, is given by:

$$V_{out}(T)=V_{GO}+V_t(\gamma-\alpha)\times[1+ln(T_0/T)]$$

where:

"$V_{GO}$" is the bandgap voltage of silicon at 0° K.,

"$\alpha$" is the temperature exponent of the current in the output diode, and

"$\gamma$" is related to the temperature exponent of electron mobility.

(See, "Analysis and design of Analog Integrated Circuits," 2nd edition, by Gray and Meyer, pages 289–292.)

Based on the above equation, a bandgap circuit can be designed with zero TC at a particular temperature, for example 25° C. (i.e. room temperature). However, there are still temperature-dependent terms in the equation that cause the output voltage of the circuit to show curvature over a broad temperature range.

Existing curvature correction schemes involve either a special circuit architecture, or require additional positive TC resistors to be added in series with the emitter or base of some of the $\Delta V_{be}$ transistors.

Figure 6:
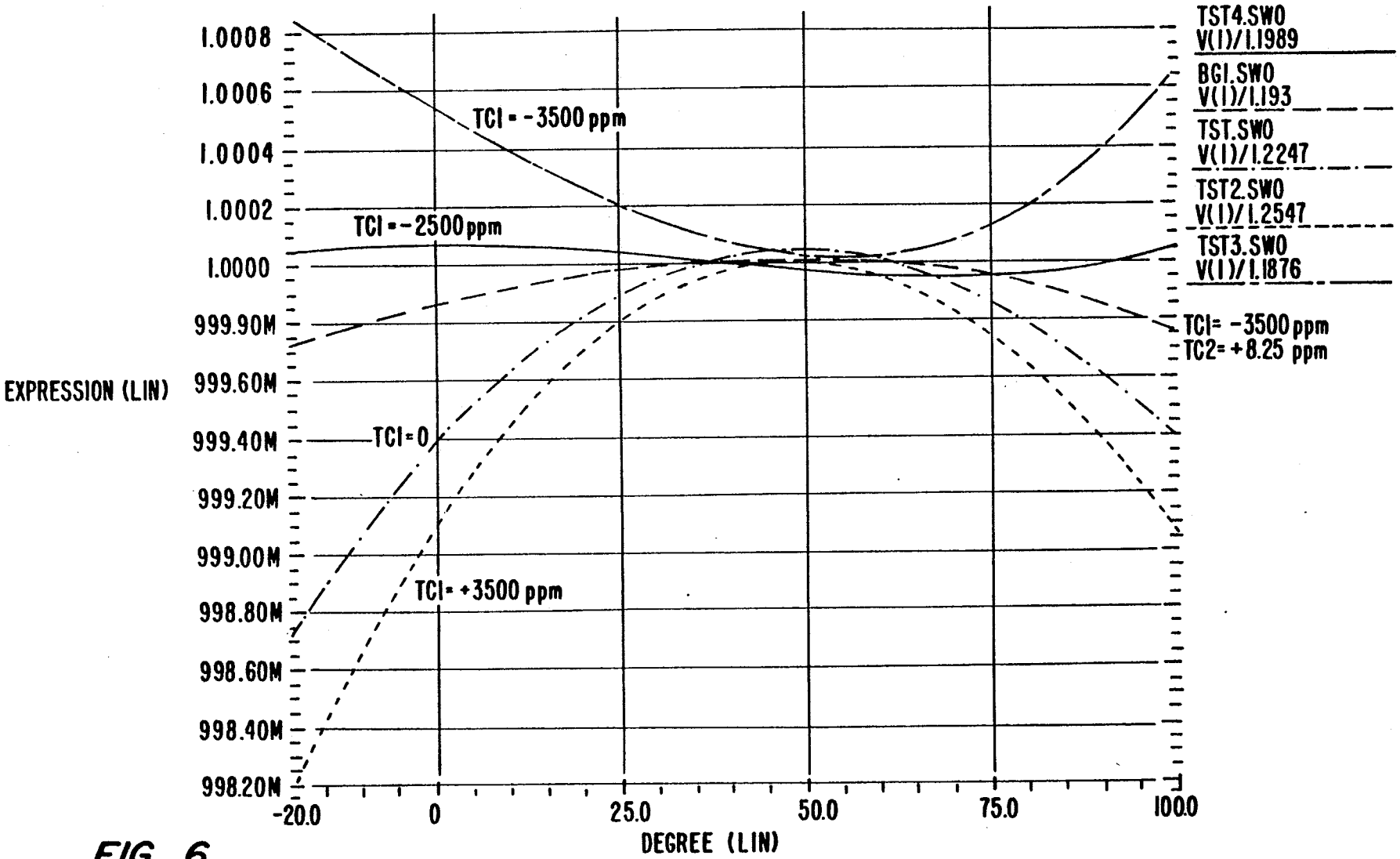
FIG. 6 illustrates the curvature of the output voltage of the bandgap circuit of the present invention over temperature, with resistors having various temperature coefficients.

The curvature correction scheme provided by a preferred embodiment of the present invention improves the curvature of a typical bandgap circuit without requiring additional circuitry. Most bandgap circuits require the two resistors R1 and R2 to set a desired ratio (switched-capacitor type bandgap circuits are one exception where resistors are replaced by switched-capacitor equivalents). Most of the different types of resistors available in integrated circuits have positive TC. Examples of such resistors are diffused, well, polysilicon, and epitaxial resistors. Instead of using such resistors, the bandgap circuit of present invention uses resistors with negative TC. The current flowing through a negative TC resistor would have positive TC. Therefore, with negative TC for R1 and R2, the current through the output diode PNP 114 has positive TC. This turns "$\alpha$" in the above equation for $V_{out}(T)$ into a positive term. Because "$\gamma$" is a positive term also, $\alpha$ can partially cancel its effect. If $(\gamma-\alpha)$ equals zero, then the curvature would be eliminated. FIG. 6 demonstrates the curvature of the output voltage of the bandgap circuit of the present invention with various TC's for R1 and R2.

In conclusion, the present invention offers a low voltage bandgap circuit with new trimming and curvature correction methods. While the above is a complete description of the preferred embodiment of the present invention, it is possible to use various alternatives, modifications and equivalents. For example, depending on the bandgap circuit architecture, different switching schemes can be used for parallel connection of the trimming transistors or trimming load devices. Also, the trim down device need not be limited to a single transistor or current source load. A variation of the bandgap trimming circuit may include several binary weighted trim down devices, similar to the described trim up structure. The trimming and curvature correction methods of the present invention can also be used in a bandgap circuit that uses NPN bipolar devices instead of PNP. Therefore, the scope of the present invention should be determined not with reference to the above description but should, instead, be determined with reference to the appended claims, along with their full scope of equivalents.

What is claimed is:

1. A low voltage bandgap circuit, coupled between a power supply terminal and ground, comprising:

a first plurality of PNP transistors having grounded collector terminals, with a base terminal of each of said first plurality of PNP transistors coupled to an emitter terminal of a next one of said first plurality of PNP transistors;

a second plurality of PNP transistors having grounded collector terminals, with a base terminal of each of said second plurality of PNP transistors coupled to an emitter terminal of a next one of said second plurality of PNP transistors;

a first plurality of load devices, each coupling an emitter terminal of a corresponding one of said first plurality of PNP transistors to the power supply;

a second plurality of load devices, each coupling an emitter terminal of a corresponding one of said second plurality of PNP transistors to the power supply;

a CMOS amplifier having NMOS input transistors, with a first input coupled to an emitter terminal of a first one of said first plurality of PNP transistors, a second input coupled to an emitter terminal of a first one of said second plurality of PNP transistors, and an output coupled to the bandgap circuit output;

a first resistor having a first terminal coupled to said amplifier output and a second terminal coupled to a base terminal of a last one of said second plurality of PNP transistors;

a second resistor having a first terminal coupled to said first resistor second terminal and a second terminal coupled to a base terminal of a last one of said first plurality of PNP transistors; and a diode connected PNP transistor having an emitter terminal coupled to said second resistor second terminal, and a base and collector terminal coupled to ground.

2. The low voltage bandgap circuit of claim 1, wherein a size of each one of said second plurality of PNP transistors is a factor of N larger than a size of each corresponding one of said first plurality of PNP transistors.

3. The low voltage bandgap circuit of claim 2, further comprising a transistor trimming circuit having a plurality of control inputs, said transistor trimming circuit further comprising:

at least one trim down PNP transistor having grounded collector terminal, with emitter terminal coupled to said amplifier first input;

at least one trip up PNP transistor having grounded collector terminal, with emitter terminal coupled to said amplifier second input;

at least one trim down switch, coupling a base terminal of a corresponding one of said at least one trim down PNP transistor to a base terminal of said first one of said first plurality of PNP transistors;

at least one trim up switch, coupling a base terminal of a corresponding one of said at least one trip up PNP transistor to a base terminal of said first one of said second plurality of PNP transistors; and a switch control circuit having a plurality of inputs coupled to said plurality of transistor trimming circuit inputs, and a plurality of outputs each coupled to a control terminal of each one of said at least one trim down and at least one trim up switches, respectively.

4. The low voltage bandgap circuit of claim 3, wherein a size of each one of said plurality of trim up PNP transistors is progressively binary weighted.

5. A low voltage bandgap circuit, coupled between a power supply terminal and ground, comprising:

a first plurality of PNP transistors having grounded collector terminals, with a base terminal of each of said first plurality of PNP transistors coupled to an emitter terminal of a next one of said first plurality of PNP transistors;

a second plurality of PNP transistors having grounded collector terminals, with a base terminal of each of said second plurality of PNP transistors coupled to an emitter terminal of a next one of said second plurality of PNP transistors;

a first plurality of load devices, each coupling an emitter terminal of a corresponding one of said first plurality of PNP transistors to the power supply;

a second plurality of load devices, each coupling an emitter terminal of a corresponding one of said second plurality of PNP transistors to the power supply;

an amplifier having a first input coupled to an emitter terminal of a first one of said first plurality of PNP transistors, a second input coupled to an emitter terminal of a first one of said second plurality of PNP transistors, and an output coupled to the bandgap circuit output;

a first resistor having a first terminal coupled to said amplifier output and a second terminal coupled to a base terminal of a last one of said second plurality of PNP transistors;

a second resistor having a first terminal coupled to said first resistor second terminal and a second terminal coupled to a base terminal of a last one of said first plurality of PNP transistors;

a third resistor having a first terminal coupled to said second resistor second terminal; and a diode connected PNP transistor having an emitter terminal coupled to a second terminal of said third resistor, and a base and collector terminal coupled to ground.

6. A low voltage bandgap circuit, coupled between a power supply terminal and ground, comprising:

a first plurality of PNP transistors having grounded collector terminals, with a base terminal of each of said first plurality of PNP transistors coupled to an emitter terminal of a next one of said first plurality of PNP transistors;

a second plurality of PNP transistors having grounded collector terminals, with a base terminal of each of said second plurality of PNP transistors coupled to an emitter terminal of a next one of said second plurality of PNP transistors;

a first plurality of load devices, each coupling an emitter terminal of a corresponding one of said first plurality of PNP transistors to the power supply;

a second plurality of load devices, each coupling an emitter terminal of a corresponding one of said second plurality of PNP transistors to the power supply;

a CMOS amplifier having NMOS input transistors, with a first input coupled to an emitter terminal of a fist one of said first plurality of PNP transistors, a second input coupled to an emitter terminal of a first one of said second plurality of PNP transistors, and an output coupled to the bandgap circuit output;

a first resistor having a first terminal coupled to said amplifier output and a second terminal coupled to a base terminal of a last one of said second plurality of PNP transistors;

a second resistor having a first terminal coupled to said first resistor second terminal and a second terminal coupled to a base terminal of a last one of said first plurality of PNP transistors;

a third resistor having a first terminal coupled to said second resistor second terminal;

a diode connected PNP transistor having an emitter terminal coupled to a second terminal of said third resistor, and a base and collector terminal coupled to ground;

at least one trim down PNP transistor having grounded collector terminal, with emitter terminal coupled to said amplifier first input;

at least one trim up PNP transistor having grounded collector terminal, with emitter terminal coupled to said amplifier second input;

at least one trim down switch, coupling a base terminal of a corresponding one of said at least one trim down PNP transistor to a base terminal of said first one of said first plurality of PNP transistors;

at least one trim up switch, coupling a base terminal of a corresponding one of said at least one trim up PNP transistor to a base terminal of said first one of said second plurality of PNP transistors; and a switch control circuit having a plurality of inputs coupled to said plurality of transistor trimming circuit inputs, and a plurality of outputs each coupled to a control terminal of each one of said at least one trim down and at least one trim up switches, respectively.

7. The low voltage bandgap circuit of claim 2, wherein said first and second plurality of load devices are current source loads, with sizes which cause a magnitude of current in each one of said first plurality of current source loads a factor of N times larger than a magnitude of current in each one of said second plurality of current source loads.

8. The low voltage bandgap circuit of claim 7, further comprising a current trimming circuit having a plurality of inputs, said current trimming circuit further comprising:

at least one trim down current source load coupled in parallel to one of said second plurality of current source loads, and having a control terminal coupled to a corresponding one of said plurality of current trimming circuit inputs; and at least one trim up current source load coupled in parallel to one of said first plurality of current source loads, and having a control terminal coupled to a corresponding one of said plurality of current trimming circuit inputs.

9. The low voltage bandgap circuit of claim 1, wherein said first and second resistors are of a type having a negative temperature coefficient.

10. The low voltage bandgap circuit of claim 5, wherein said first, second, and third resistors are of a type having a negative temperature coefficient.

11. The low voltage bandgap circuit of claim 6, wherein said first, second, and third resistors are of a type having a negative temperature coefficient.

12. In a bandgap reference circuit that generates a delta $V_{be}$ term by ratioing a size of a first bipolar transistor coupled to a first input of an amplifier, to a second bipolar transistor coupled to a second input of the amplifier, a new trimming circuit comprising:

at least one trim down bipolar transistor coupled in parallel to the first bipolar transistor; and at least one trim up bipolar transistor coupled in parallel to the second bipolar transistor, wherein, the size ratioing between the first and the second bipolar transistor is changed by activating a combination of said at least one trim down or trim up bipolar transistors to trim the bandgap reference.

13. The trimming circuit of claim 12, wherein at least one of said one trim down and trim up bipolar transistors is a plurality of bipolar transistors having transistor sizes that are progressively binary weighted.

14. The trimming circuit of claim 12, wherein said at least one trim down and trim up bipolar transistors couple in parallel to said first and said second bipolar transistors through respective switches.

15. In a bandgap reference circuit that generates a delta $V_{be}$ term by ratioing a magnitude of current in a first current source load for a first bipolar transistor coupled to a first input of an amplifier, to a magnitude of current in a second current source load for a second bipolar transistor coupled to a second input of the amplifier, a new trimming circuit comprising:

at least one trim down current source load coupled in parallel to the first current source load; and at least one trim up current source load coupled in parallel to the second current source load, wherein, the ratio of the magnitude of current in the first current source load to the magnitude of current in the second current source load is changed by turning on a combination of said at least one trim down and trim up current source loads to trim the bandgap reference circuit.

16. The trimming circuit of claim 15, wherein at least one of said at least one trim down and trim up current source loads is a plurality of current source loads having load sizes that are progressively binary weighted.

17. The trimming circuit of claim 15, wherein said at least one trim down and trim up current source loads coupled in parallel to said first and second current source load through respective switches.

18. In a bandgap reference circuit having a device generating a Vbe term, an improved curvature correction means for inducing a current with increased positive temperature coefficient through said device.

19. The curvature correction means of claim 18 wherein the bandgap reference circuit uses a ratio of a first resistor to a second resistor to generate a constant factor multiplying a delta $V_{be}$ term, and wherein said first and second resistors are of a type having a negative temperature coefficient to induce said current with a positive temperature coefficient through said device.

20. A low voltage bandgap circuit, coupled between a power supply terminal and ground, comprising:

a first PNP transistor having a grounded collector terminal, a base terminal, and an emitter terminal;

a second PNP transistor having a grounded collector terminal, a base terminal, and an emitter terminal;

a first load device coupling said emitter terminal of said first PNP transistor to the power supply;

a second load device coupling said emitter terminal of said second PNP transistor to the power supply;

a second load device coupling said emitter terminal of said second PNP transistor to the power supply;

a CMOS amplifier having NMOS input transistors, with a first input coupled to said emitter terminal of said first PNP transistor, a second input coupled to said emitter terminal of said second PNP transistor, and an output coupled to the bandgap circuit output;

a first resistor having a first terminal coupled to said amplifier output and a second terminal coupled to said base terminal of said second PNP transistor;

a second resistor having a first terminal coupled to said first resistor second terminal and a second terminal coupled to said base terminal of said first PNP transistor; and a diode connected PNP transistor having an emitter terminal coupled to said second resistor second terminal, and a base and collector terminal coupled to ground.

21. The low voltage bandgap circuit of claim 20, wherein a size of said second PNP transistor is a factor of N larger than a size of said first plurality of PNP transistor.

* * * * *